US011104166B2

(12) United States Patent
Sugata

(10) Patent No.: US 11,104,166 B2
(45) Date of Patent: Aug. 31, 2021

(54) PRINTER AND PRINTING SYSTEM

(71) Applicant: FUJIFILM Business Innovation Corp., Tokyo (JP)

(72) Inventor: Tomokazu Sugata, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/531,320

(22) Filed: Aug. 5, 2019

(65) Prior Publication Data

US 2020/0298602 A1 Sep. 24, 2020

(30) Foreign Application Priority Data

Mar. 19, 2019 (JP) ..... JP2019-050560

(51) Int. Cl.
*B41J 29/393* (2006.01)
*G03G 15/01* (2006.01)
*B41J 2/21* (2006.01)

(52) U.S. Cl.
CPC ..... *B41J 29/393* (2013.01); *B41J 2/2103* (2013.01); *G03G 15/01* (2013.01); *B41J 2029/3935* (2013.01)

(58) Field of Classification Search
CPC .. B41J 29/393; B41J 29/38; B41J 2029/3935; B41J 2/2103; G03G 15/01
USPC ..... 347/5, 15, 19
See application file for complete search history.

(56) References Cited

U.S. PATENT DOCUMENTS 9,844,961 B1 * 12/2017 Mantell ..... B41J 2/2142
10,596,843 B2 * 3/2020 Sugata ..... B41J 29/393
2014/0186076 A1 * 7/2014 Murayama ..... G03G 15/5058 399/301

FOREIGN PATENT DOCUMENTS

JP 2006-187909 A 7/2006

* cited by examiner

*Primary Examiner* — An H Do
(74) *Attorney, Agent, or Firm* — Sughrue Mion, PLLC

(57) ABSTRACT

A printer includes a first printing unit responsible for one of preceding printing and subsequent printing that are to be performed on one sheet in overprinting, an other of the preceding printing and the subsequent printing being performed by a second printing unit; and a base-printing controller that causes the first printing unit to print a base for printing by the second printing unit in an operation of forming a test pattern for registration between the preceding printing and the subsequent printing on the sheet.

20 Claims, 10 Drawing Sheets

PRINTER AND PRINTING SYSTEM

CROSS-REFERENCE TO RELATED APPLICATIONS

This application is based on and claims priority under 35 USC 119 from Japanese Patent Application No. 2019-050560 filed Mar. 19, 2019.

BACKGROUND

(i) Technical Field

The present disclosure relates to a printer and a printing system.

(ii) Related Art

Overprinting is occasionally performed in which two kinds of printing, i.e. preceding printing and subsequent printing, are performed with two printers or with one printer while colorants to be used for the two kinds of printing are changed. In overprinting, particularly in a case where different printers are used between preceding printing and subsequent printing, registration between the preceding printing and the subsequent printing is necessary. In the registration, a test pattern as a combination of a test pattern for the preceding printing and a test pattern for the subsequent printing is printed on one sheet and is read with a scanner so that misregistration between the preceding printing and the subsequent printing is found. Then, printing positions and the like are adjusted such that the misregistration is reduced.

In a technique disclosed by Japanese Unexamined Patent Application Publication No. 2006-187909, the tension to be applied to a web on which an image is to be formed is adjusted in accordance with the degree of misregistration between a registration mark for preceding printing and a registration mark for subsequent printing that are formed on the web, whereby an image to be formed in the subsequent printing is expanded or contracted in such a manner as to fit an image formed in the preceding printing.

SUMMARY

In the above technique, the test pattern may need to be printed with, for example, a white colorant on a white sheet. In such a case, the printed test pattern that is read with a scanner may result in a signal with a contrast at an unsatisfactory level.

Aspects of non-limiting embodiments of the present disclosure relate to a printer and a printing system each configured to print a test pattern that is readable as a signal with a contrast at a more satisfactory level than in a case where no base is printed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a printer including a first printing unit responsible for one of preceding printing and subsequent printing that are to be performed on one sheet in overprinting, an other of the preceding printing and the subsequent printing being performed by a second printing unit; and a base-printing controller that causes the first printing unit to print a base for printing by the second printing unit in an operation of forming a test pattern for registration between the preceding printing and the subsequent printing on the sheet.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will now be described.

Figure 1:
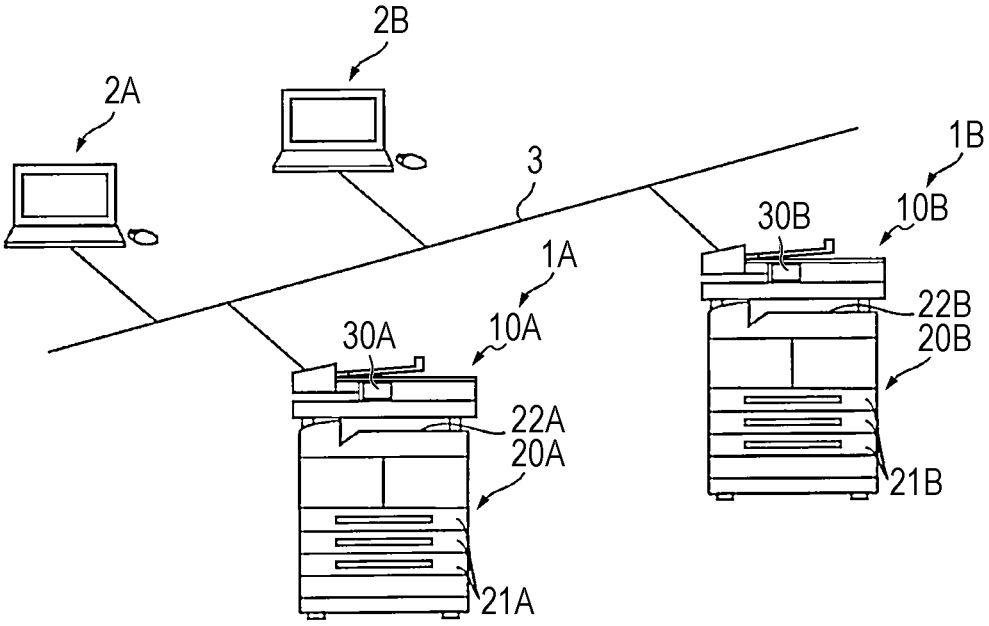
FIG. 1 illustrates a first exemplary printing system.

FIG. 1 illustrates a first exemplary printing system. In FIG. 1, first and second multifunction machines 1A and 1B and personal computers (hereinafter abbreviated to PCs) 2A and 2B are illustrated. The multifunction machines 1A and 1B and the PCs 2A and 2B are connected to one another with a communication line 3. For easy recognition, the communication line 3 in FIG. 1 is illustrated as if it is for wired communication. Alternatively, the communication line 3 may be for wireless communication.

The multifunction machines 1A and 1B include respective scanners 10A and 10B, and respective printers 20A and 20B. The scanners 10A and 10B each read an image on an original and generates a corresponding image signal. The image signal is transmitted to a designated one of the PCs 2A and 2B. The scanners 10A and 10B each include a sensor that reads the image on the original by decomposing the image into three primary colors of red (R), green (G), and blue (B).

Therefore, the scanners 10A and 10B are each capable of reading a color image on the original.

The printers 20A and 20B of the respective multifunction machines 1A and 1B each receive the image signal transmitted thereto from the one of the PCs 2A and 2B and print an image based on the received image signal on a sheet. The multifunction machines 1A and 1B include respective sheet trays 21A and 21B in which sheets yet to be subjected to printing are stored. The printer 20A or 20B prints an image on a sheet as follows. A sheet is picked up from one of the sheet trays 21A or 21B, and an image is printed on that sheet. The sheet having an image printed thereon is outputted onto a sheet output tray 22A or 22B.

The multifunction machines 1A and 1B each have a copying function. Copying on the multifunction machine 1A or 1B is performed as follows. An image on an original is first read by the scanner 10A or 10B. Then, the printer 20A or 20B receives an image signal acquired through the reading, and prints an image based on the image signal on a sheet.

The multifunction machines 1A and 1B further include respective touch-panel user interfaces (hereinafter abbreviated to UIs) 30A and 30B. The UIs 30A and 30B each display various pieces of information for users. When the UI 30A or 30B is operated through touching by a user, a corresponding one of various instructions that is selected by the user is transmitted to the multifunction machine 1A or 1B.

Herein, a so-called electrophotographic multifunction machine that performs printing with toners as colorants is taken as an example. However, the present disclosure is not limited to an electrophotographic machine and is also applicable to a printer that performs printing by any other method such as an inkjet method.

The printers 20A and 20B of the multifunction machines 1A and 1B each perform printing by using toners having four respective colors at the maximum. The printer 20A of the first multifunction machine 1A uses toners having four respective colors of yellow (Y), magenta (M), cyan (C), and black (K), which are used for typical printing. The printer 20B of the second multifunction machine 1B uses toners having four other colors including at least one special color such as clear (CL: transparent), white (W), or the like. Herein, printing with multiple colors, including such a special color, is performed in overprinting including preceding printing and succeeding printing. To perform overprinting, the first multifunction machine 1A first performs printing on a sheet with the toners having the four colors of Y, M, C, and K, which is herein referred to as preceding printing. Subsequently, the sheet having undergone the preceding printing is set in the sheet tray 21B of the second multifunction machine 1B. Then, the multifunction machine 1B performs succeeding printing on that sheet by using the special color. Thus, overprinting with multiple colors including a special color is performed.

Prior to the above overprinting, registration (including adjustment of inclination and magnification) between the preceding printing and the succeeding printing needs to be performed. The registration is performed as follows.

Figure 2A:
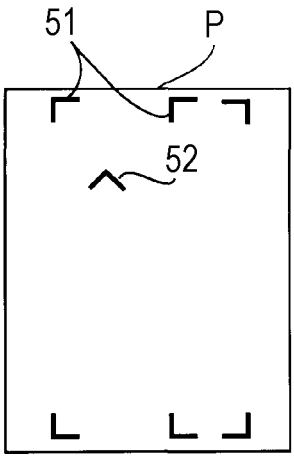
FIGS. 2A to 2C illustrate a test pattern according to a comparative embodiment.
Figure 2B:
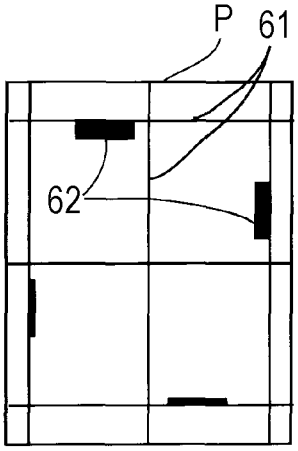
Figure 2C:
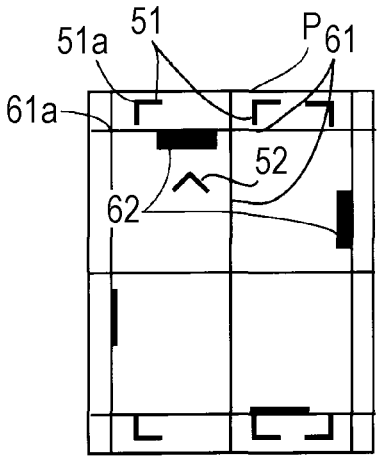

FIGS. 2A to 2C illustrate a test pattern according to a comparative embodiment to be compared with test patterns according to exemplary embodiments of the present disclosure that will be described separately below. FIG. 2A illustrates a first pattern included in the test pattern and to be printed by the multifunction machine 1A. FIG. 2B illustrates a second pattern included in the test pattern and to be printed by the multifunction machine 1B. FIG. 2C illustrates the test pattern formed of the first pattern in FIG. 2A and the second pattern in FIG. 2B printed thereover.

An instruction for printing of the test pattern is made through an operation performed on the UI 30A of the multifunction machine 1A. In response to the instruction, the first pattern illustrated in FIG. 2A is printed on a sheet P. The first pattern includes bracket marks 51 indicating positions on the sheet P, and a direction mark 52 indicating a sheet-advancing direction in which the sheet P picked up from the sheet tray 21A advances. The bracket marks 51 and the direction mark 52 are printed at respective positions that are predetermined in accordance with the size of the sheet P. The bracket marks 51 are used for detecting misregistration and are printed at six positions, respectively, for accuracy improvement or double check.

The sheet P having the first pattern in FIG. 2A printed thereon by the multifunction machine 1A is set in the sheet tray 21B of the second multifunction machine 1B. Then, an instruction for printing of the test pattern is made through an operation performed on the UI 30B of the multifunction machine 1B. In response to the instruction, the second pattern illustrated in FIG. 2B is printed on the sheet P. In this step, the second pattern illustrated in FIG. 2B is additionally printed on the sheet P already having the first pattern illustrated in FIG. 2A. Consequently, the test pattern illustrated in FIG. 2C is formed on the sheet P outputted onto the sheet output tray 22B of the multifunction machine 1B. Herein, for easy understanding, the second pattern additionally printed by the multifunction machine 1B will be described with reference to FIG. 2B.

The second pattern illustrated in FIG. 2B includes lengthwise and widthwise line marks 61 and a plurality of rectangular marks 62. The second pattern (FIG. 2B) to be printed by the second multifunction machine 1B differs greatly from the first pattern (FIG. 2A) to be printed by the first multifunction machine 1A so that the two patterns printed by the respective multifunction machines 1A and 1B are clearly distinguishable from each other when the two patterns are superposed one on top of the other (FIG. 2C).

The line marks 61 and the rectangular marks 62 in the second pattern illustrated in FIG. 2B are printed at respective positions that are predetermined in accordance with the size of the sheet P. The lengthwise and widthwise line marks 61 form points of intersections to be used for detection of misregistration. The line marks 61 include three lengthwise lines and three widthwise lines for accuracy improvement or double check. The rectangular marks 62 each indicate, in accordance with the widths thereof, the sheet-advancing direction in which the sheet P picked up from the sheet tray 21B advances. Specifically, in the second pattern illustrated in FIG. 2B, one of the rectangular marks 62 that is nearest to the leading end of the sheet P is wider in the sheet-advancing direction than another one of the rectangular marks 62 that is nearest to the trailing end of the sheet P. Furthermore, in the second pattern illustrated in FIG. 2B, one of the rectangular marks 62 that is nearest to the right end of the sheet P is wider in a sheet-width direction intersecting the sheet-advancing direction than another one of the rectangular marks 62 that is nearest to the left end of the sheet P. The different rectangular marks 62 having different sizes both in the sheet-advancing direction and in the sheet-width direction are provided so that the sheet-advancing direction is double-checkable.

As illustrated in FIG. 2C, the sheet P outputted to the sheet output tray 22B of the multifunction machine 1B for succeeding printing has the test pattern formed of the two patterns printed by the two respective multifunction machines 1A and 1B. As a reference for the detection of misregistration or for the registration, reference values are predetermined for the relative distance and positional relationship between a corner 51*a* of each of the bracket marks 51 and an intersection 61*a* between a corresponding one of pairs of the line marks 61 that is closest to the corner 51*a* in the test pattern illustrated in FIG. 2C.

The test pattern illustrated in FIG. 2C is read by the scanner 10B of the multifunction machine 1B, and whether the orientation of the sheet P that is detected with reference to the direction mark 52 and the rectangular marks 62 on the image represented by the image signal acquired through the reading of the test pattern is correct is checked first. If the orientation is incorrect, correct registration is not performed. Therefore, the multifunction machine 1B refrains from registration, and notifies the user of the incorrectness in the orientation of the sheet P. Unless the sheet P having the first pattern in FIG. 2A printed thereon by the first multifunction machine 1A is set in the correct orientation on the sheet tray 21B of the second multifunction machine 1B, the orientations of the two patterns do not accord with each other.

If the orientation of the sheet P is correct, the positions of the corners 51*a* of the bracket marks 51 and the intersections 61*a* between the line marks 61 are detected. Then, conditions for the second multifunction machine 1B such as the printing position and the magnification are adjusted such that the relative distance and positional relationship between each of the corners 51*a* and a corresponding one of the intersections 61*a* accord with the respective reference values. Alternatively, the test pattern illustrated in FIG. 2C may be read by the scanner 10A of the first multifunction machine 1A, and the conditions for the first multifunction machine 1A such as the printing position and the magnification may be adjusted.

The above description is based on the premise that all of the marks in the first pattern in FIG. 2A printed by the first multifunction machine 1A and all of the marks in the second pattern in FIG. 2B printed by the second multifunction machine 1B are clearly readable by the scanner 10B. Note that the second multifunction machine 1B uses a special color. Depending on the kinds of the special color, it may be difficult for the scanner 10B to clearly read the second pattern printed with the special color.

Figure 3:
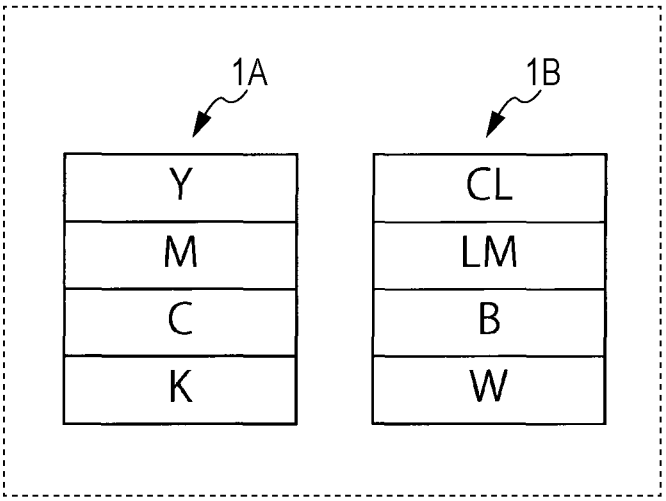
FIG. 3 illustrates exemplary colors of toners allocated to first and second multifunction machines.

FIG. 3 illustrates exemplary colors of toners allocated to the two multifunction machines 1A and 1B.

In the case illustrated in FIG. 3, the first multifunction machine 1A is allocated with toners having four colors of yellow (Y), magenta (M), cyan (C), and black (K), and the second multifunction machine 1B is allocated with toners having other four colors of clear (CL: transparent), light magenta (LM), blue (B), and white (W). The toners, excluding the blue (B) toner, allocated to the second multifunction machine 1B are toners that may be difficult for the scanner 10B to read as signals at satisfactory levels.

The multifunction machines 1A and 1B each include four printing engines, to which toners having the above colors are allocated, respectively. Multifunction machines include those having various restrictions on the printing of a test pattern, such as those in which the engine capable of printing a test pattern is fixed, and those in which a plurality of engines are each capable of printing a test pattern but the number of lines printable by each of the engines is limited. In addition, W (white) may be used as a base for other colors and, in that case, needs to be printed on the sheet in such a manner as to serve as the base for the other colors. Furthermore, CL (clear) is used for giving a gloss by being printed over the other colors on the sheet. Under such circumstances, some toners may need to be allocated to specific ones of the four engines, depending on the colors thereof. Herein, considering such various restrictions, a case where the first multifunction machine 1A prints a pattern with the K (black) toner while the second multifunction machine 1B prints a pattern with the W (white) toner will be described.

Figure 4A:
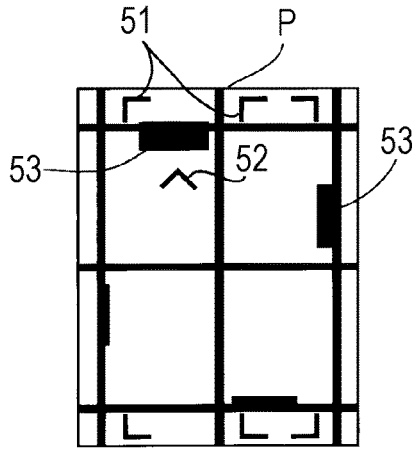
FIGS. 4A to 4C illustrate a test pattern according to a first exemplary embodiment.
Figure 4B:
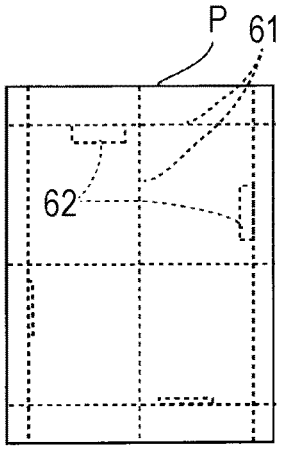
Figure 4C:
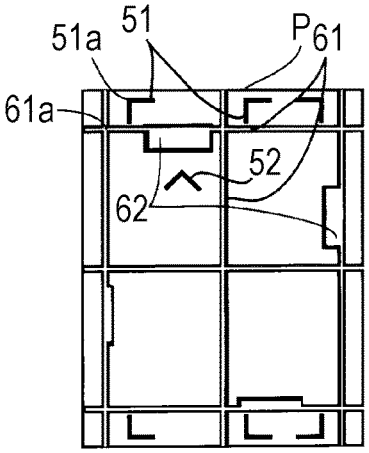

FIGS. 4A to 4C illustrate a test pattern according to a first exemplary embodiment of the present disclosure. As with FIGS. 2A to 2C, FIG. 4A illustrates a first pattern to be printed by the multifunction machine 1A, FIG. 4B illustrates a second pattern to be printed by the multifunction machine 1B, and FIG. 4C illustrates the test pattern formed of the first pattern in FIG. 4A and the second pattern in FIG. 4B printed thereover. The meanings of the marks in the patterns are the same as those illustrated in FIGS. 2A to 2C. Accordingly, redundant description is omitted, and differences from those illustrated in FIGS. 2A to 2C will be described. This also applies to test patterns according to a second and subsequent exemplary embodiments to be described below.

As described above, FIG. 4B illustrates a second pattern to be printed with the W (white) toner. The second pattern is unreadable as it is by the scanner 10B. Hence, in the first exemplary embodiment, the first multifunction machine 1A prints the first pattern illustrated in FIG. 2A for the first multifunction machine 1A and a base pattern 53 serving as the base for the second pattern to be printed by the second multifunction machine 1B. The base pattern 53 is formed of segments wider than the respective segments forming the second pattern for the second multifunction machine 1B. The second multifunction machine 1B prints the second pattern for the second multifunction machine 1B as illustrated in FIG. 4B on a sheet P already having the pattern in FIG. 4A, including the base pattern 53, printed by the first multifunction machine 1A. Consequently, the pattern illustrated in FIG. 4C is obtained in which the base pattern 53 printed by the first multifunction machine 1A appears around the edge of the second pattern printed by the second multifunction machine 1B. Then, the sheet P illustrated in FIG. 4C is read by the scanner 10B. Thus, the respective patterns printed by the first and second multifunction machines 1A and 1B become clearly readable.

Figure 5A:
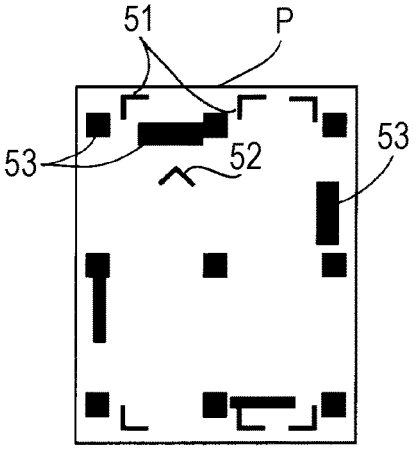
FIGS. 5A to 5C illustrate a test pattern according to a second exemplary embodiment.
Figure 5B:
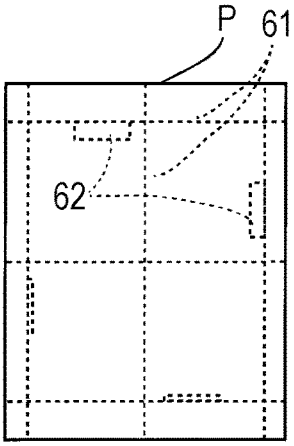
Figure 5C:
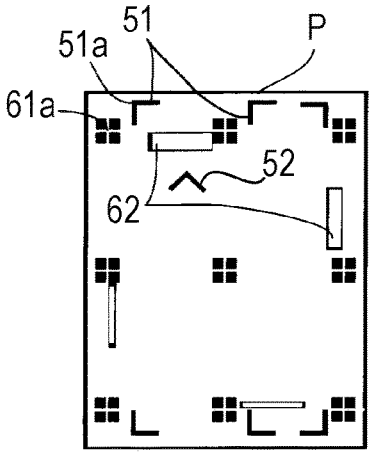

FIGS. 5A to 5C illustrate a test pattern according to a second exemplary embodiment.

As described above with reference to FIG. 2C, in the second pattern for the second multifunction machine 1B, the positions of the intersections between the lengthwise lines and the widthwise lines and the widths of the rectangular marks are to be considered carefully. In FIG. 5A, the base pattern 53 is printed such that only necessary portions of the second pattern for the second multifunction machine 1B become visible.

Figure 6A:
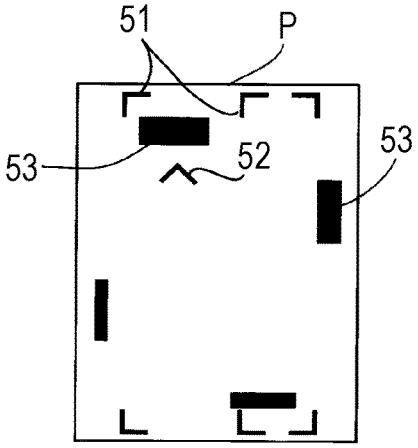
FIGS. 6A to 6C illustrate a test pattern according to a third exemplary embodiment.
Figure 6B:
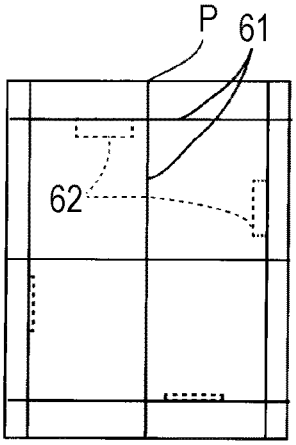
Figure 6C:
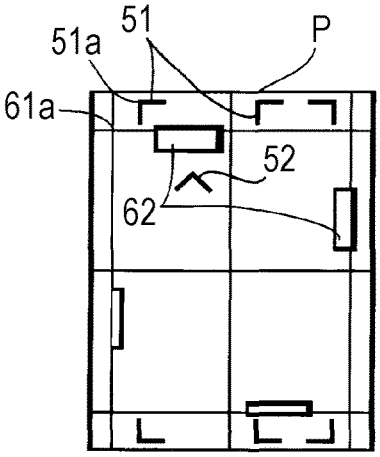

FIGS. 6A to 6C illustrate a test pattern according to a third exemplary embodiment.

In the third exemplary embodiment, the second multifunction machine 1B prints the pattern with an engine for the B (blue) toner, which is clearly readable by the scanner 10B. However, the number of lines to be included in the pattern printable with each of the engines of the multifunction machine 1B is limited. Therefore, the second multifunction machine 1B is not capable of printing all of the lines and marks in the second pattern with only one engine. Hence, in the third exemplary embodiment, the lengthwise and widthwise line marks 61 are printed in B (blue), whereas the rectangular marks 62 are printed in W (white). In such a case, the first multifunction machine 1A prints the first pattern for the first multifunction machine 1A and a base pattern 53 formed of segments corresponding to the rectangular marks 62 included in the second pattern for the second multifunction machine 1B.

As in the first to third exemplary embodiments illustrated in FIGS. 4A to 4C, 5A to 5C, and 6A to 6C, the first multifunction machine 1A prints not only the first pattern for the first multifunction machine 1A but also the base pattern 53 formed of segments corresponding to portions of the second pattern for the second multifunction machine 1B that are considered to be too light for the scanner 10B to simply read. Thus, the second pattern for the second multifunction machine 1B become readable with the scanner 10B.

Hereinafter, as a matter of simplicity, situations including one where the base pattern is printed only for portions of the second pattern for the second multifunction machine 1B that are considered to be too light for the scanner 10B to simply read will be simply described as a situation where the base pattern is printed for the second pattern for the second multifunction machine 1B.

Figure 7:
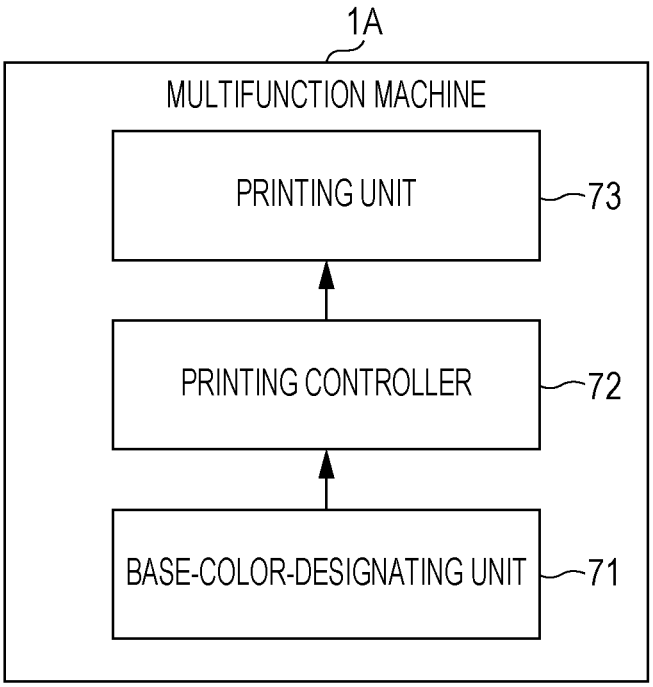
FIG. 7 is a first functional block diagram of the first multifunction machine that realizes a function of printing a first pattern including a base pattern.

FIG. 7 is a first functional block diagram of the first multifunction machine 1A that realizes the function of printing the first pattern including the base pattern.

The multifunction machine 1A includes functions of a base-color-designating unit 71, a printing controller 72, and a printing unit 73. The printing controller 72 includes an example of the base-printing controller according to the present disclosure. The printing unit 73 corresponds to an example of the first printing unit according to the present disclosure.

The base-color-designating unit 71 receives information on the color of the base pattern that is designated by a user's operation performed on the UI 30A, and transmits the designated color of the base pattern to the printing controller 72. The first to third exemplary embodiments illustrated in FIGS. 4A to 4C, 5A to 5C, and 6A to 6C have been described as a limited case where the base pattern is printed in K (black) and the second pattern is printed thereover in W (white), for easy understanding. Practically, there are also other cases. Furthermore, the above exemplary embodiments have been described about a case where the multifunction machine 1A performs preceding printing, and the multifunction machine 1B performs succeeding printing. Practically, there may be a vice-versa case. For example, the multifunction machine 1A may be provided for succeeding printing, but the first pattern of the test pattern that is to be printed by the multifunction machine 1A provided for succeeding printing may be printed first. Hence, herein, more options including K (black) are provided for the color of the base pattern, and the base-color-designating unit 71 is provided so as to accept the designation of the color of the base pattern through the user's operation on the UI 30A. In such a configuration, the colors of the toners allocated to the multifunction machine 1A may be displayed on the screen of the UI 30A so that a desired color of the base pattern is designatable from among those colors. In the case illustrated in FIG. 7, any of the colors that are printable as the base pattern by the multifunction machine 1A is designatable. However, it is expected that one of the colors that produces, when the test pattern is read, a greater signal difference between a mark printed over the base pattern and the base pattern appearing at the edge of the mark than a signal difference between a portion of the sheet where no base pattern is present and the mark printed on the portion of the sheet is designated as the color of the base pattern. A typical color combination for the base pattern and the mark that produces the greatest signal difference is a color combination of black and white.

The printing controller 72 illustrated in FIG. 7 receives the designated color of the base pattern from the base-color-designating unit 71, generates a signal representing the base pattern and the first pattern for the multifunction machine 1A in the designated color, and transmits the patterns and the designated color (engine) to the printing unit 73. Then, the printing unit 73 prints the patterns on a sheet in the designated color.

Figure 8:
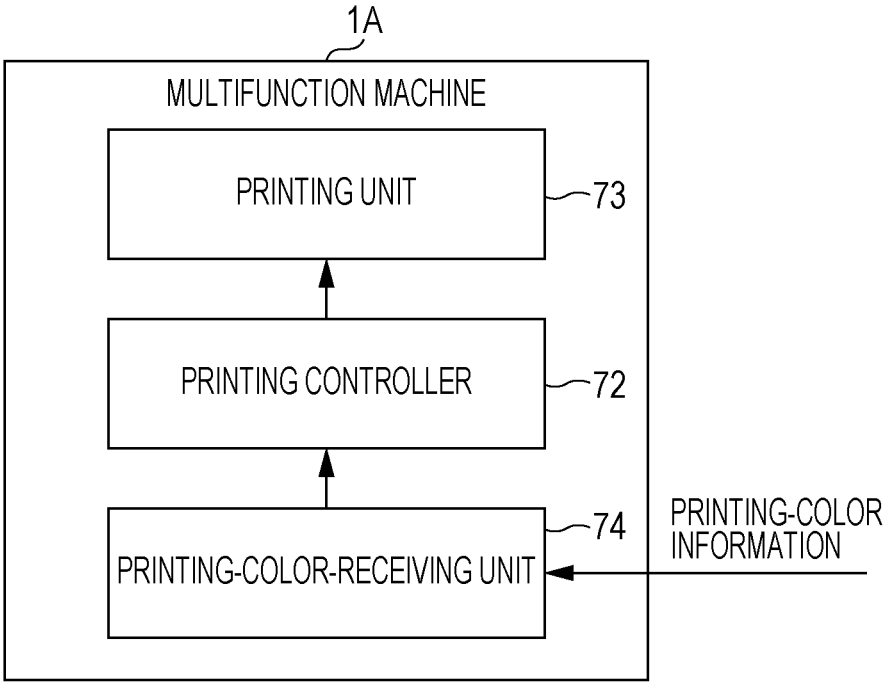
FIG. 8 is a second functional block diagram of the first multifunction machine that realizes the function of printing the first pattern including the base pattern.

FIG. 8 is a second functional block diagram of the first multifunction machine 1A that realizes the function of printing the first pattern including the base pattern.

Figure 9:
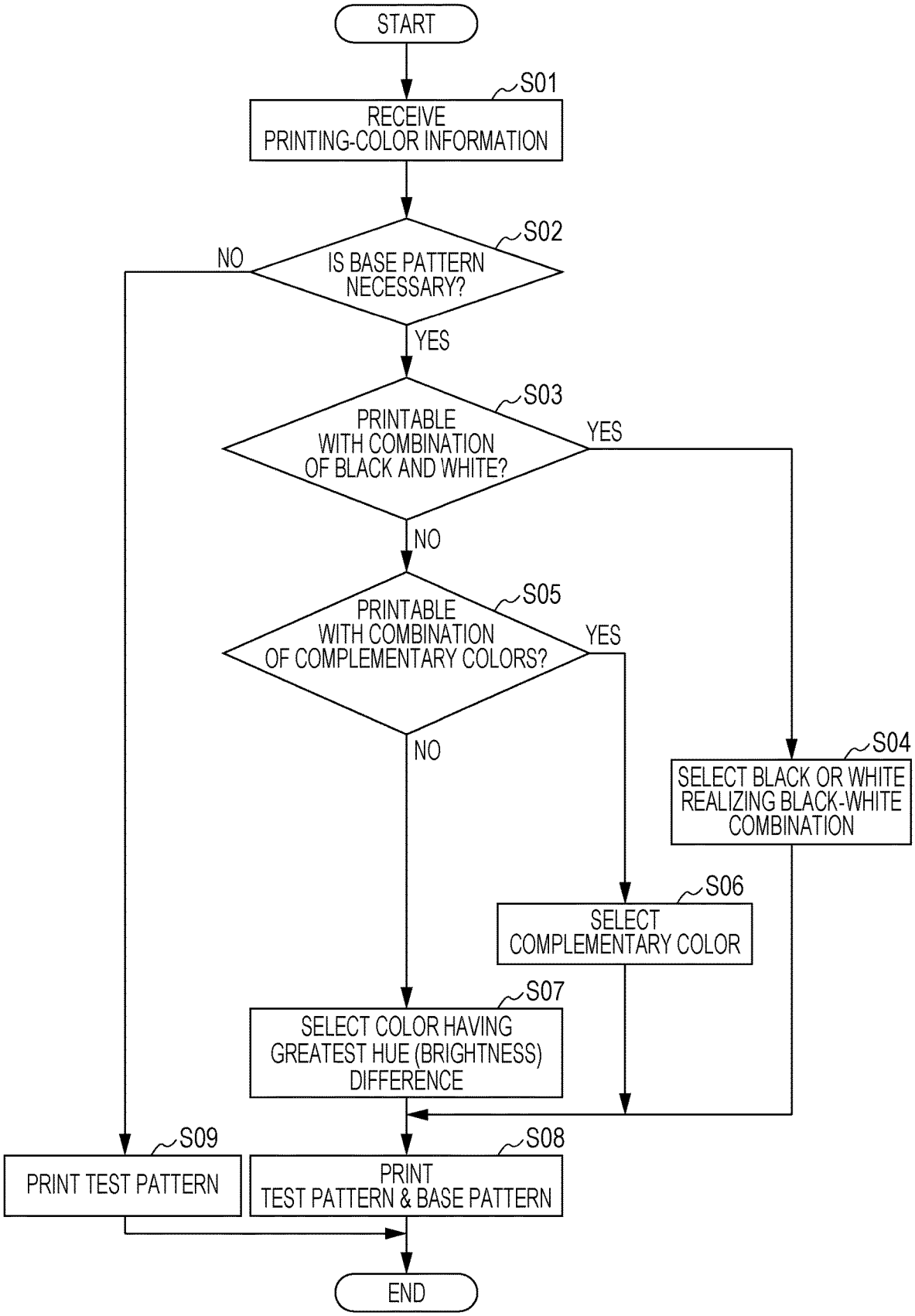
FIG. 9 is a flow chart illustrating a process performed by the first multifunction machine employing the second functional block illustrated in FIG. 8.

FIG. 9 is a flow chart illustrating a process performed by the multifunction machine 1A employing the second functional block illustrated in FIG. 8.

The multifunction machine 1A illustrated in FIG. 8 includes a printing-color-receiving unit 74 instead of the base-color-designating unit 71 illustrated in FIG. 7. The printing-color-receiving unit 74 receives information on the color of the second pattern to be printed by the second multifunction machine 1B from the second multifunction machine 1B via the communication line 3 illustrated in FIG. 1 (step S01). In this case, for example, the color information may be received as the coordinates on the chromaticity diagram such as the coordinates in the L*a*b* color space, or more precisely the spectral-distribution characteristic, instead of the name of the color such as blue or white.

The printing controller 72 receives the above printing-color information and first checks whether the base pattern needs to be printed (step S02). If the test pattern to be printed by the second multifunction machine 1B has a color clearly readable by the scanner 10B without the aid of the base pattern, the base pattern is not necessary. If the printing controller 72 has determined that the base pattern needs to be printed, the printing controller 72 then determines in which color the base pattern is to be printed. In this step of deciding the color of the base pattern, as described above with reference to FIG. 7, the color that produces, when the test pattern is read, a greater signal difference between the mark printed over the base pattern and the base pattern appearing at the edge of the mark than a signal difference between a portion of the sheet where no base pattern is present and the mark printed on the portion of the sheet is designated as the color of the base pattern, as a first condition. A typical color combination for the base pattern and the mark that produces the greatest signal difference is a color combination of black and white. Hence, the printing controller 72 first checks whether the base pattern and the mark are printable with the color combination of black and white. If the base pattern and the mark are printable with the color combination of black and white, black or white that realizes the black-white color combination for the base pattern and the mark is designated as the color of the base pattern (step S04).

If the base pattern and the mark are not printable with the color combination of black and white, the printing controller 72 checks the possibility of another color combination. In the example illustrated in FIG. 9, the printing controller 72 checks whether the base pattern and the mark are printable with a combination of complementary colors (step S05). If the base pattern and the mark are printable with a combination of complementary colors, a color complementary to the color of the mark is designated as the color of the base pattern (step S06).

If the base pattern and the mark are not printable with a combination of complementary colors, one of the plurality of toners for the first multifunction machine 1A that has a color farthest in hue from the color of the test pattern to be printed by the second multifunction machine 1B is designated (step S07). Herein, a general case is described including a case where the multifunction machine 1A is provided for succeeding printing. Therefore, the toners handleable with the multifunction machine 1A are not limited to those having four colors of yellow (Y), magenta (M), cyan (C), and black (K). In step S07, a toner having a color farthest in hue from the color of the test pattern is designated from the plurality of toners handleable with the multifunction machine 1A. However, if the multifunction machine 1A is operable with toners having the four colors of yellow (Y), magenta (M), cyan (C), and black (K), one of the four toners that has a color farthest in hue from the color of the test pattern is designated. In step S07, brightness instead of hue may be taken as a reference, and a toner having a color farthest in brightness from the color of the test pattern to be printed by the second multifunction machine 1B may be designated from the plurality of toners allocated to the multifunction machine 1A. When the color of the base pattern is designated as above, the printing controller 72 generates a signal representing the base pattern and the first pattern for the first multifunction machine 1A in the designated color, and transmits the patterns and the designated color (engine) to the printing unit 73. Then, the printing unit 73 prints the patterns in the designated color (step S08). The color of the base pattern may be a mixture of any of the colors allocated to the plurality of engines. If it is determined that the base pattern is not necessary (step S02), only the first pattern for the multifunction machine 1A, with no base pattern, is printed (step S09).

Figure 10:
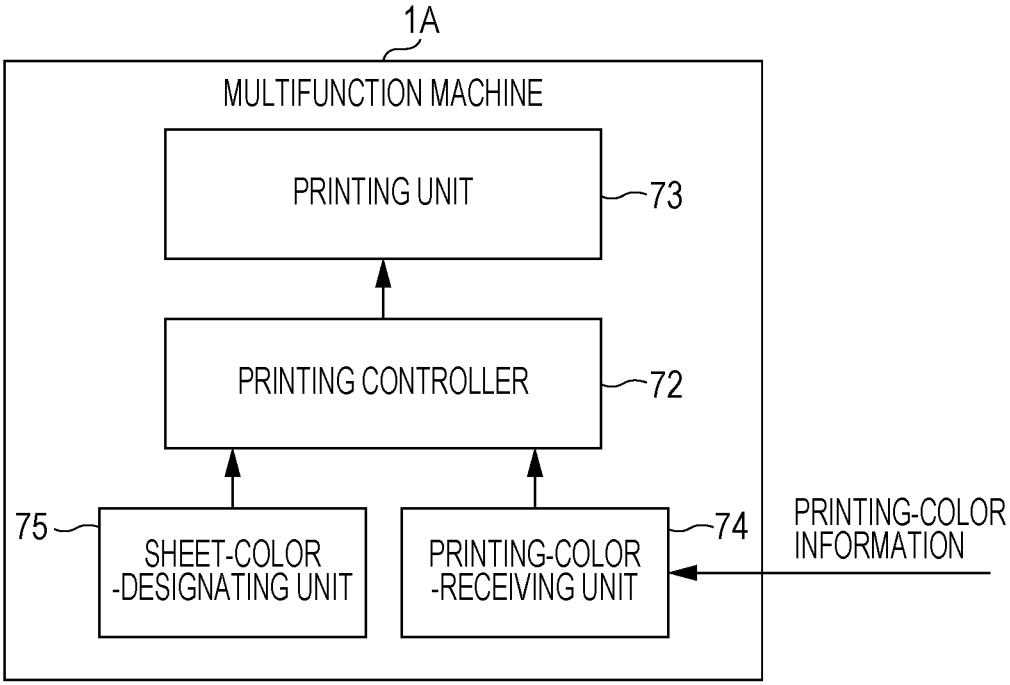
FIG. 10 is a third functional block diagram of the first multifunction machine that realizes the function of printing the first pattern including the base pattern.

FIG. 10 is a third functional block diagram of the first multifunction machine 1A that realizes the function of printing the first pattern including the base pattern.

Figure 11:
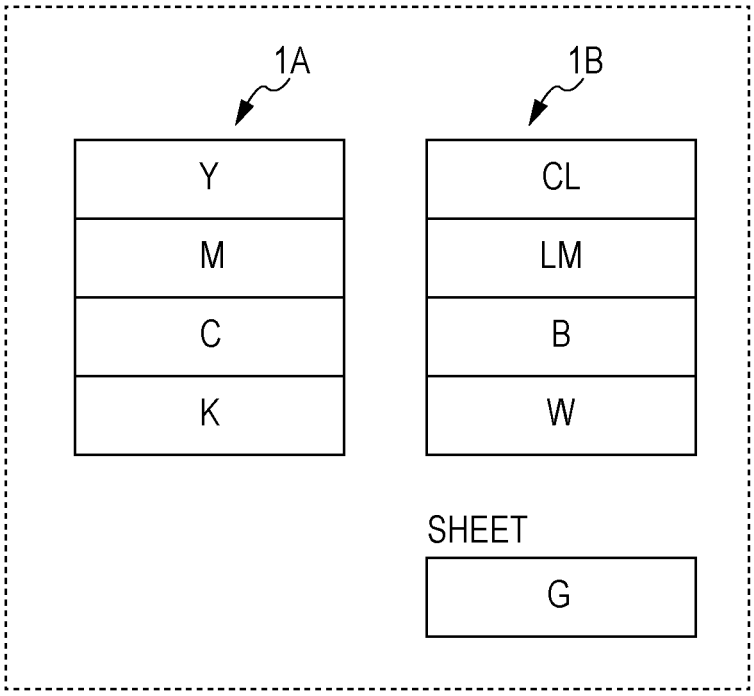
FIG. 11 illustrates exemplary colors of toners allocated to the first and second multifunction machines and an exemplary color of sheets to be used in the multifunction machines.

FIG. 11 illustrates exemplary colors of toners allocated to the two multifunction machines 1A and 1B and an exemplary color of sheets to be used in the multifunction machines 1A and 1B.

As with the case illustrated in FIG. 3, toners having the four colors of yellow (Y), magenta (M), cyan (C), and black (K) are allocated to the first multifunction machine 1A, and toners having other four colors of clear (CL: transparent), light magenta (LM), blue (B), and white (W) are allocated to the second multifunction machine 1B. FIG. 11 further illustrates that the color of sheets to be used is green (G).

The functional block illustrated in FIG. 10 is obtained by adding a sheet-color-designating unit 75 to the functional block illustrated in FIG. 8. The above exemplary embodiments have been described on the premise that sheets are white, for example, with no consideration for the color thereof. The occurrence of misregistration between the printing performed with the first multifunction machine 1A and the printing performed with the second multifunction machine 1B also depends on the kind of sheets. Therefore, it is desirable to print a test pattern on a sheet of the kind that is actually used in forming a printed material desired by the user. The color of the sheet to be used actually is not limited to white. Hence, in the following description, the color of the sheet is also taken into consideration.

The sheet-color-designating unit 75 designates the color of the sheet to be used for the printing of the test pattern. The sheet-color-designating unit 75 may acquire information on the color of the sheet through a user's operation performed on the UI 30A. Alternatively, before the test pattern is printed, the sheet may be read by the scanner 10A. Then, the color of the sheet may be identified from a signal value acquired through the reading. In the case of the functional block illustrated in FIG. 10, the printing controller 72 determines whether the base pattern is necessary and, if necessary, the color of the base pattern, with consideration for the information on the color of the test pattern to be printed by the second multifunction machine 1B that has been received by the printing-color-receiving unit 74, and the color of the sheet as well. The other details are the same as in the case illustrated in FIG. 8, and redundant description is omitted.

If the color of the sheet is taken into consideration, the color of the first pattern to be printed by the first multifunction machine 1A may also be designated with consideration for the color of the sheet.

FIGS. 12A to 12G illustrate exemplary combinations of a mark and a base pattern that are available as part of the test pattern. In FIGS. 12A to 12G, the base pattern is illustrated in black, and the mark is illustrated in white with a black closing line so that the mark is recognized clearly. In FIGS. 12A to 12G, arrow S represents a sheet-transporting direction in the printing of the test pattern. The sheet-transporting direction is identified from the orientation of the direction mark 52 illustrated in FIG. 2A and the widths of the rectangular marks 62 illustrated in FIG. 2B.

Figure 12A:
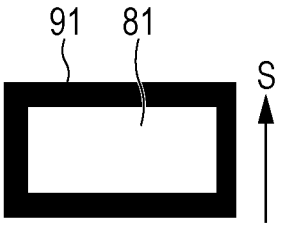
FIGS. 12A to 12G illustrate exemplary combinations of a mark and a base pattern that are available as part of the test pattern.

In FIG. 12A, a base pattern 91 appears around the entire edge of a rectangular mark 81. Such a base pattern appearing around the entire edge of the mark is widely usable but may lead to an excessive increase in toner consumption in the printing of the base pattern.

Figure 12B:
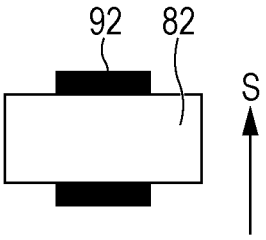

In FIG. 12B, a base pattern 92 appears on two sides of a mark 82 in the sheet-transporting direction S. If the object of detection is the length of the mark 82 in the sheet-transporting direction S, the base pattern 92 only needs to appear on the two sides of the mark 82 in the sheet-transporting direction S as illustrated in FIG. 12B.

Figure 12C:
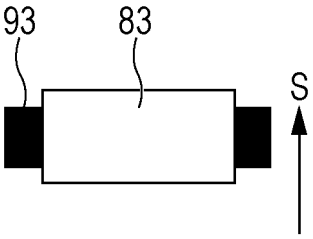

In FIG. 12C, a base pattern 93 appears on two sides of a mark 83 in the sheet-width direction intersecting the sheet-transporting direction S. If the object of detection is the length of the mark 83 in the sheet-width direction, the base pattern 93 only needs to appear on the two sides of the mark 83 in the sheet-width direction as illustrated in FIG. 12C.

Figure 12D:
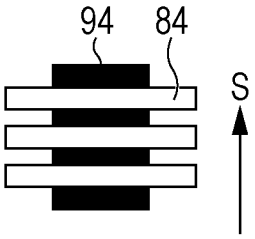

In FIG. 12D, a plurality of marks 84 each elongated in the sheet-width direction are arranged side by side in the sheet-transporting direction S, and a base pattern 94 appears on two sides of each of the marks 84 in the sheet-transporting direction S. If the object of detection is the number of marks arranged side by side in the sheet-transporting direction S, the base pattern 94 is effective. In the pattern illustrated in FIG. 2B, the sheet-transporting direction S is identified from the widths of the rectangular marks 62. Alternatively, the sheet-transporting direction S may be identified from the number of marks.

Figure 12E:
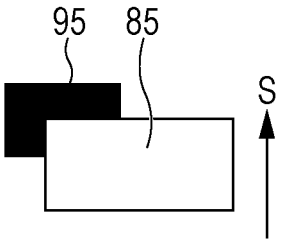

In FIG. 12E, a base pattern 95 appears at the upper left corner of a rectangular mark 85. If the object of detection is the position of the upper left corner of the rectangular mark 85, a base pattern having a color contrast to the mark 85 only needs to be present at the upper left corner of the mark 85.

Figure 12F:
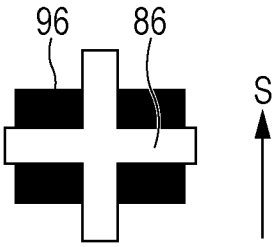

In FIG. 12F, a mark 86 includes two line segments extending in the sheet-transporting direction S and the sheet-width direction, respectively, forming an intersection therebetween. A base pattern 96 appears around the intersection. If the object of detection is the position of the intersection in the mark 86, the base pattern 96 is effective. The mark 86 and the base pattern 96 illustrated in FIG. 12F are employed in the pattern illustrated in FIG. 5C.

Figure 12G:
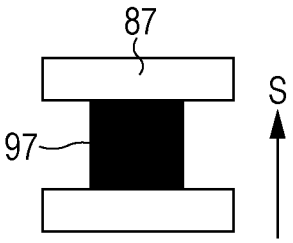

In FIG. 12G, two marks 87 are spaced apart from each other, and a base pattern 97 extends in such a manner as to fill the space between the two marks 87. If the object of detection is the gap between two marks, the base pattern 97 is effective.

Figure 13:
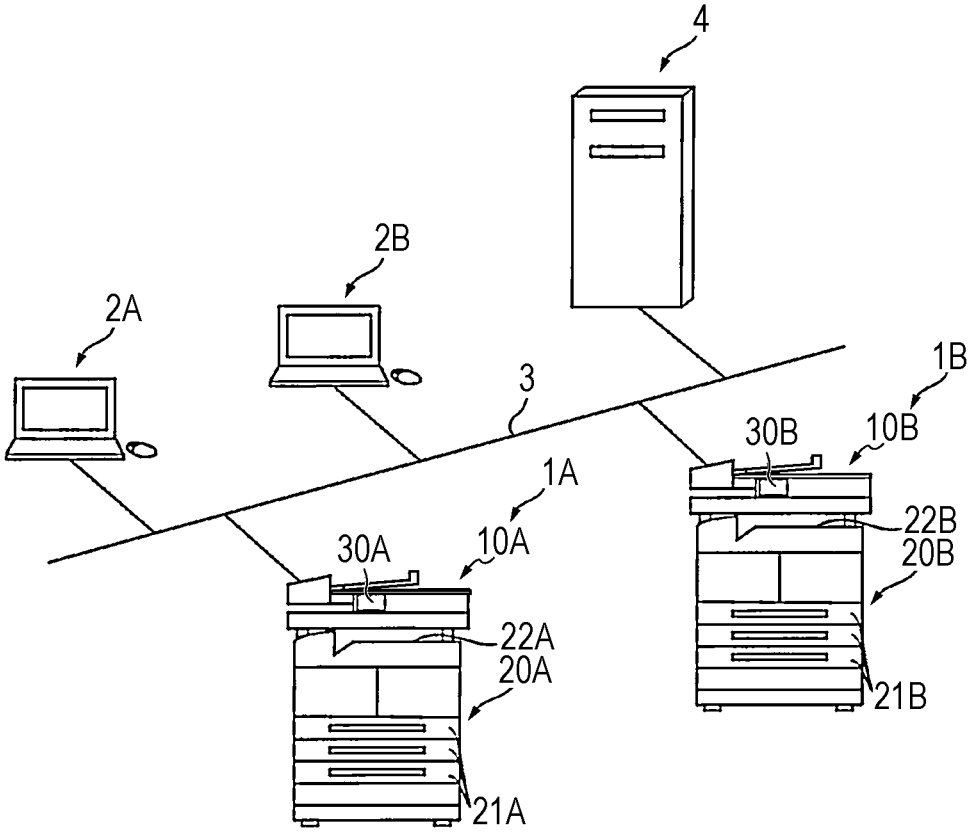
FIG. 13 illustrates a second exemplary printing system.

FIG. 13 illustrates a second exemplary printing system. The printing system illustrated in FIG. 13 differs from the printing system illustrated in FIG. 1 in including a server 4.

Figure 14:
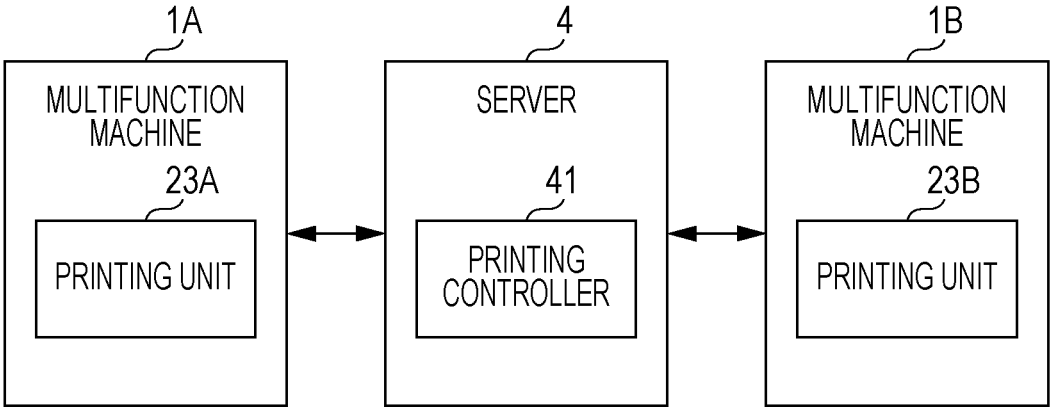
FIG. 14 is a functional block diagram of the printing system that realize the function of printing the test pattern.

FIG. 14 is a functional block diagram of the printing system that realizes the function of printing the test pattern.

In each of the first to third functional blocks illustrated in FIGS. 7, 8, and 10, the printing controller 72 is provided in the multifunction machine 1A. In the functional block illustrated in FIG. 14, a printing controller 41 is provided in the server 4. The printing controller 41 in the server 4 stores information on the colors of toners allocated to the two multifunction machines 1A and 1B, and combinations of those toners and the engines. The printing controller 41 also stores information on the sheet color that is acquired through the reading with the scanner 10A. Thus, in the functional block illustrated in FIG. 14, all necessary information is collected to the printing controller 41 provided in the server 4. To print a test pattern in such a case, the printing controller 41 in the server 4 checks whether the base pattern is necessary. If the base pattern is necessary, the printing controller 41 determines the color of the base pattern and notifies the multifunction machine 1A of the result. In a printing unit 23A of the multifunction machine 1A, the first pattern and the base pattern, if necessary, are printed on a sheet in accordance with the notification. The sheet having undergone the printing is then set in the second multifunction machine 1B, and the second pattern for the second multifunction machine 1B is printed by a printing unit 23B included in the second multifunction machine 1B. Thus, the server 4 may have a function of controlling the printing of the base pattern.

In the functional block illustrated in FIG. 14, not only the necessity of the base pattern but also the colors of the patterns to be printed by the respective multifunction machines 1A and 1B may be determined and notified to the multifunction machines 1A and 1B, with consideration for the correspondence between the colors of the toners and the engines allocated to the two multifunction machines 1A and 1B.

As described above, according to each of the above exemplary embodiments of the present disclosure, a test pattern readable as a signal with a contrast at a more satisfactory level is printed than in a system in which no base pattern is printed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A printer comprising:

a first printing unit responsible for one of preceding printing and subsequent printing that are to be performed on one sheet in overprinting, an other of the preceding printing and the subsequent printing being performed by a second printing unit; and a base-printing controller that causes the first printing unit to print a base for printing by the second printing unit in an operation of forming a test pattern for registration between the preceding printing and the subsequent printing on the sheet.

2. The printer according to claim 1, wherein the test pattern is a combination of a first pattern to be printed by the first printing unit and a second pattern to be printed by the second printing unit, and wherein the base-printing controller causes the first printing unit to print the base such that the base appears at an edge of a mark to be printed over the base by the second printing unit, the mark being included in the second pattern.

3. The printer according to claim 2, wherein the base-printing controller causes the first printing unit to print the base with a colorant that produces, when the test pattern is read, a greater signal difference between the mark printed over the base and the base appearing at the edge of the mark than a signal difference between a portion of the sheet where no base is present and the mark on the portion of the sheet.

4. The printer according to claim 2, wherein one of the base and the mark is printed with a white colorant, and an other of the base and the mark is printed with a black colorant.

5. The printer according to claim 2, wherein the colorant for the base has a color complementary to a color of a colorant for the mark.

6. The printer according to claim 2, wherein the first printing unit is operable with colorants having a plurality of colors, respectively, and wherein a colorant for the base is one of the colorants handleable with the first printing unit that has a greatest hue difference from a colorant for the mark.

7. The printer according to claim 2, wherein the first printing unit is operable with colorants having a plurality of colors, respectively, and wherein a colorant for the base is one of the colorants handleable with the first printing unit that has a greatest brightness difference from a colorant for the mark.

8. The printer according to claim 2, wherein the base-printing controller causes the first printing unit to print the base such that the base appears around an entire edge of the mark.

9. The printer according to claim 2, wherein the base-printing controller causes the first printing unit to print the base such that the base appears on two sides of the mark in a predetermined first direction.

10. The printer according to claim 9, wherein the first direction is a sheet-transporting direction in printing.

11. The printer according to claim 9, wherein the first direction is a sheet-width direction intersecting a sheet-transporting direction in printing.

12. The printer according to claim 2, wherein the mark includes a plurality of marks that are each elongated in a second direction intersecting a predetermined first direction and are arranged side by side in the first direction, and wherein the base-printing controller causes the first printing unit to print the base such that the base appears on two sides of each of the marks in the first direction.

13. The printer according to claim 2, wherein the mark has a shape with a corner, and wherein the base-printing controller causes the first printing unit to print the base such that the base appears at the corner of the mark.

14. The printer according to claim 2, wherein the mark includes two line segments extending in two respective directions in such a manner as to form an intersection, and wherein the base-printing controller causes the first printing unit to print the base such that the base appears around the intersection.

15. The printer according to claim 2, wherein the mark includes two marks that are spaced apart from each other, and wherein the base-printing controller causes the first printing unit to print the base such that the base appears in such a manner as to fill the space between the two marks.

16. A printing system comprising:

a first printing unit and a second printing unit that are each responsible for a corresponding one of preceding printing and subsequent printing that are to be performed on one sheet in overprinting; and a base-printing controller that causes the first printing unit to print a base for printing by the second printing unit in an operation of forming a test pattern for registration between the preceding printing and the subsequent printing on the sheet.

17. The printing system according to claim 16, wherein the base-printing controller allows the first printing unit to print the base or prohibits the first printing unit from printing the base, in accordance with a colorant for the mark.

18. The printing system according to claim 17, wherein the base-printing controller allows the first printing unit to print the base or prohibits the first printing unit from printing the base, in accordance with a colorant for the mark and a color of the sheet.

19. The printing system according to claim 18, wherein the base-printing controller causes the first printing unit to print the base with a colorant determined in accordance with a colorant for the mark and a color of the sheet.

20. The printing system according to claim 16, wherein the test pattern is a combination of a first pattern to be printed by the first printing unit and a second pattern to be printed by the second printing unit, the second pattern including a mark that is printed over the base, and wherein the base-printing controller causes the first printing unit to print the base with a colorant determined in accordance with a colorant for the mark.

* * * * *